US005750949A

United States Patent [19]

Rees et al.

[11] Patent Number: 5,750,949

[45] Date of Patent: May 12, 1998

[54] METAL-ENCAPSULATED, GAS-INSULATED HIGH-VOLTAGE CIRCUIT-BREAKER

[75] Inventors: Volker Rees, Darmstadt; Martin Schumacher, Rodenbach; Horst Plettner, Hanau, all of Germany

[73] Assignee: ABB Patent GmbH, Mannheim, Germany

[21] Appl. No.: 712,105

[22] Filed: Sep. 13, 1996

[30] Foreign Application Priority Data

Sep. 13, 1995 [DE] Germany ..... 195 33 794.8

[51] Int. Cl.[6] ..... H01H 33/88

[52] U.S. Cl. ..... 218/43

[58] Field of Search ..... 218/43, 46, 48–53, 218/68, 72, 76, 77, 78

[56] References Cited

U.S. PATENT DOCUMENTS 4,511,775 4/1985 Korner et al. .
4,577,074 3/1986 Pham .
4,939,322 7/1990 Kashimura et al. .
5,276,285 1/1994 Pham et al. .
5,478,980 12/1995 Freeman et al. .

*Primary Examiner*—Matthew V. Nguyen
*Attorney, Agent, or Firm*—Herbert L. Lerner; Laurence A. Greenberg

[57] ABSTRACT

A metal-encapsulated, gas-insulated high-voltage circuit-breaker includes a fixed contact configuration which is accommodated in its own fixed contact housing, and a moving contact piece configuration which is driven by a first drive and is accommodated in a contact housing that is connected to the moving contact piece configuration or can move with said contact piece configuration during a switching operation. The contact configurations may have contact pieces for a rated current and for guiding and extinguishing an arc. At the same time, a device is provided for producing a gas flow. The device includes a dielectric nozzle in which the arc burns and is blown and which is guided in a sealed manner in the fixed contact housing throughout an entire switching operation. In order to achieve a disconnecter switch function, a second drive is provided which, during or after completion of the disconnection operation, drives the fixed contact housing with the fixed contact piece configuration counter to the disconnection direction of the moving contact piece configuration, in such a way that the insulating nozzle is released from its guide and an isolating path is thus achieved in order to provide a disconnecter switch function.

18 Claims, 4 Drawing Sheets

10

METAL-ENCAPSULATED, GAS-INSULATED HIGH-VOLTAGE CIRCUIT-BREAKER

BACKGROUND OF THE INVENTION

Field of the Invention

The invention relates to a metal-encapsulated, gas-insulated high-voltage circuit-breaker having a fixed contact configuration which is accommodated in its own fixed contact housing, a moving contact piece configuration which is driven by a first drive and is accommodated in a contact housing that is connected to the moving contact piece configuration or can move with the contact piece configuration during a switching operation, the contact configuration may have a contact piece for a rated current and for guiding and extinguishing an arc, and a device for producing a gas flow which includes a dielectric nozzle in which the arc burns and is blown and which is guided in a sealed manner in the fixed contact housing throughout an entire switching operation.

High-voltage circuit-breakers of the type mentioned initially, in which $SF_6$ gas is used as the insulating and extinguishing gas, have a fixed contact piece configuration and a moving contact piece configuration that are each composed of contact pieces for the rated current and contact pieces for arc extinguishing. In a number of switching devices a piston configuration having an insulating nozzle is assigned to the moving contact piece. In the piston configuration the gas pressure is increased during the disconnection operation and is fed to the arc.

In the case of gas-insulated high-voltage switching devices, the actual extinguishing chamber, that is to say the area in which the arc is extinguished, is isolated from the remaining area of the encapsulation either through an insulating cylinder or due to the fact that the insulating nozzle is guided in a guide cylinder on the contact housing of the fixed contact piece.

Since there is a mechanical connection, even if through dielectric, between the housing which surrounds the moving contact piece and the housing which contains the fixed contact piece, such switching devices cannot operate as disconnecter switches since there is a risk of creepage currents flowing through the dielectric connection, which corresponds to breakdown of the circuit-breaker.

SUMMARY OF THE INVENTION

It is accordingly an object of the invention to provide a metal-encapsulated, gas-insulated high-voltage circuit-breaker, which overcomes the hereinafore-mentioned disadvantages of the heretofore-known devices of this general type and in which a disconnecter function is also provided at the same time.

With the foregoing and other objects in view there is provided, in accordance with the invention, a metal-encapsulated, gas-insulated high-voltage circuit-breaker, comprising a fixed contact housing; a fixed contact configuration in its fixed contact housing; another contact housing; a moving contact piece configuration in the other contact housing; the other contact housing being connected to or being movable with the moving contact piece configuration during a switching operation; the contact configuration possibly having a contact piece for a rated current and for guiding and extinguishing the arc; a drive for driving the moving contact piece configuration; and a device for producing a gas flow including a dielectric nozzle in which an arc burns and is blown, the dielectric nozzle being sealingly guided in the fixed contact housing throughout an entire switching operation. According to one embodiment, the fixed contact housing with the fixed contact piece configuration and the other contact housing with the moving contact configuration can be moved away from one another during or after completion of a disconnection operation, for releasing the insulating nozzle from guidance and achieving an isolating path between the fixed contact housing and the other contact housing along with the insulating nozzle to produce a disconnecter function. According to another embodiment, a dielectric cylinder is disposed between the other contact housing and the fixed contact housing, and the fixed contact housing with the fixed contact piece configuration and the other contact housing with the moving contact configuration can be moved away from one another during or after completion of a disconnection operation, for releasing the insulating nozzle from guidance, for releasing the dielectric cylinder from the fixed contact housing and for achieving an isolating path between the fixed contact housing and the other contact housing along with the insulating nozzle and the dielectric cylinder to produce a disconnecter function.

In both cases, not only can the moving contact piece be moved together with the contact housing for the moving contact piece in the disconnection direction, but the fixed contact housing can also be moved counter to the disconnection direction of the moving contact piece until a gas path of specific length is achieved between the contact housing of the moving contact piece and the contact housing of the fixed contact piece.

In another refinement, the contact housing can also be driven in addition to the normal disconnection movement, so that the same function of an isolating path is produced by operation of the contact housing.

In accordance with another feature of the invention, in this case it is possible to provide a second drive for achieving the disconnection function and it is also possible for the drive for the moving contact piece and/or the moving contact configuration to displace the contact housing as well, so that the disconnection function is achieved.

In accordance with a further feature of the invention, the drive for the moving contact piece configuration also moves the other contact housing with the moving contact configuration, the dielectric nozzle and the dielectric cylinder into the disconnected position.

In accordance with an added feature of the invention, there is provided an outgoing conductor, a guide passage being electrically conductively connected to the outgoing conductor, and a projection being integrally formed on at least one of the housings and accommodated in and electrically conductively and displaceably guided in the guide passage.

In accordance with an additional feature of the invention, there are provided multiple contact pieces achieving the electrically conductive connection between the guide passage and the projection.

In accordance with yet another feature of the invention, the drives are disposed on mutually opposite sides of the metal encapsulation.

In accordance with a concomitant feature of the invention, the drives are disposed at the same end of the metal encapsulation.

Other features which are considered as characteristic for the invention are set forth in the appended claims.

Although the invention is illustrated and described herein as embodied in a metal-encapsulated, gas-insulated high-voltage circuit-breaker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 4:
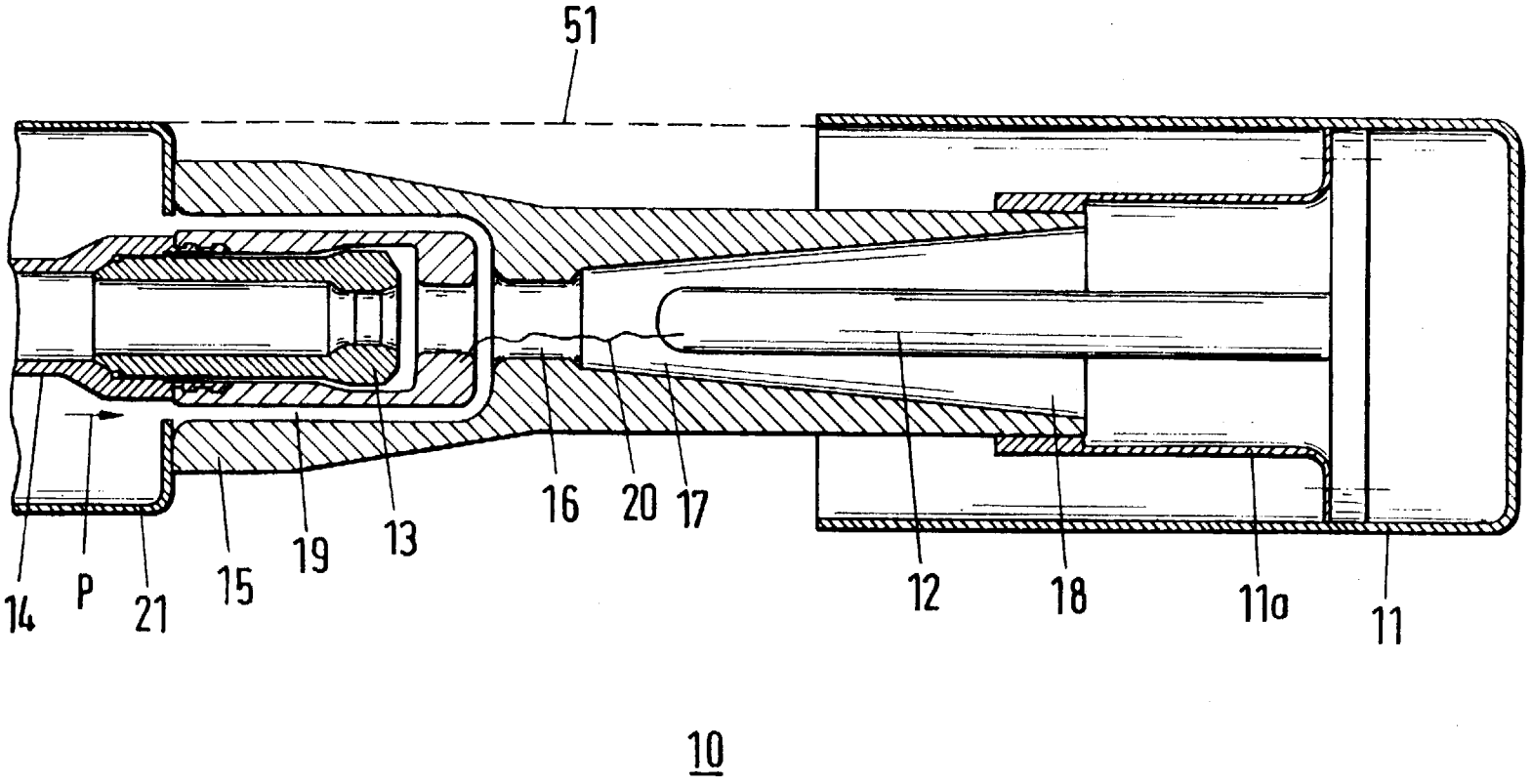
FIG. 4 is a fragmentary, sectional view of a switching device according to FIGS. 1 to 3, in the position illustrated in FIG. 2.

Referring now to the figures of the drawings in detail and first, particularly, to FIG. 4 thereof, there is seen a switching device that is a high-voltage power circuit-breaker, which is identified overall by reference numeral 10 and contains a fixed contact piece housing 11 in which a fixed contact piece 12 in the form of a rod is disposed. The way in which the fixed contact piece is held within the fixed contact housing 11 is not important to the invention. The switching device 10 furthermore has a moving contact piece 13 which is fitted to a contact tube 14 and is surrounded by a dielectric nozzle 15 that has a section 16 with the smallest diameter. The section 16 expands towards the fixed contact piece 12 through a conical region 17 to a section 18 having a large diameter. In the connected state, the fixed contact piece 12 passes through the section 16 as well as the moving contact piece 13. Insulating gas, in this case $SF_6$ gas, is fed in the direction of an arrow P through channels 19 which are disposed in the dielectric nozzle 15, to an arc 20 that is burning through the section 16, so that the arc 20 is blown and extinguished.

The gas flow P can be produced by an additional non-illustrated volume, possibly using the energy of the arc 20 itself. A metal cylinder 11*a* which is located within the contact housing 11 is firmly connected to the fixed contact housing 11 and surrounds and guides the insulating nozzle 15 in the section or area 18 in the connected state and in the disconnected state (according to FIG. 4). Such circuit-breakers are known as so-called puffer or self-blowing circuit-breakers. However, the invention is not limited to such circuit-breakers. The moving contact piece 13, the drive tube 14 and the insulating nozzle 15 are accommodated in another housing 21. Additional contact pieces, which can carry the rated current, are not illustrated, for the sake of clarity.

Figure 1:
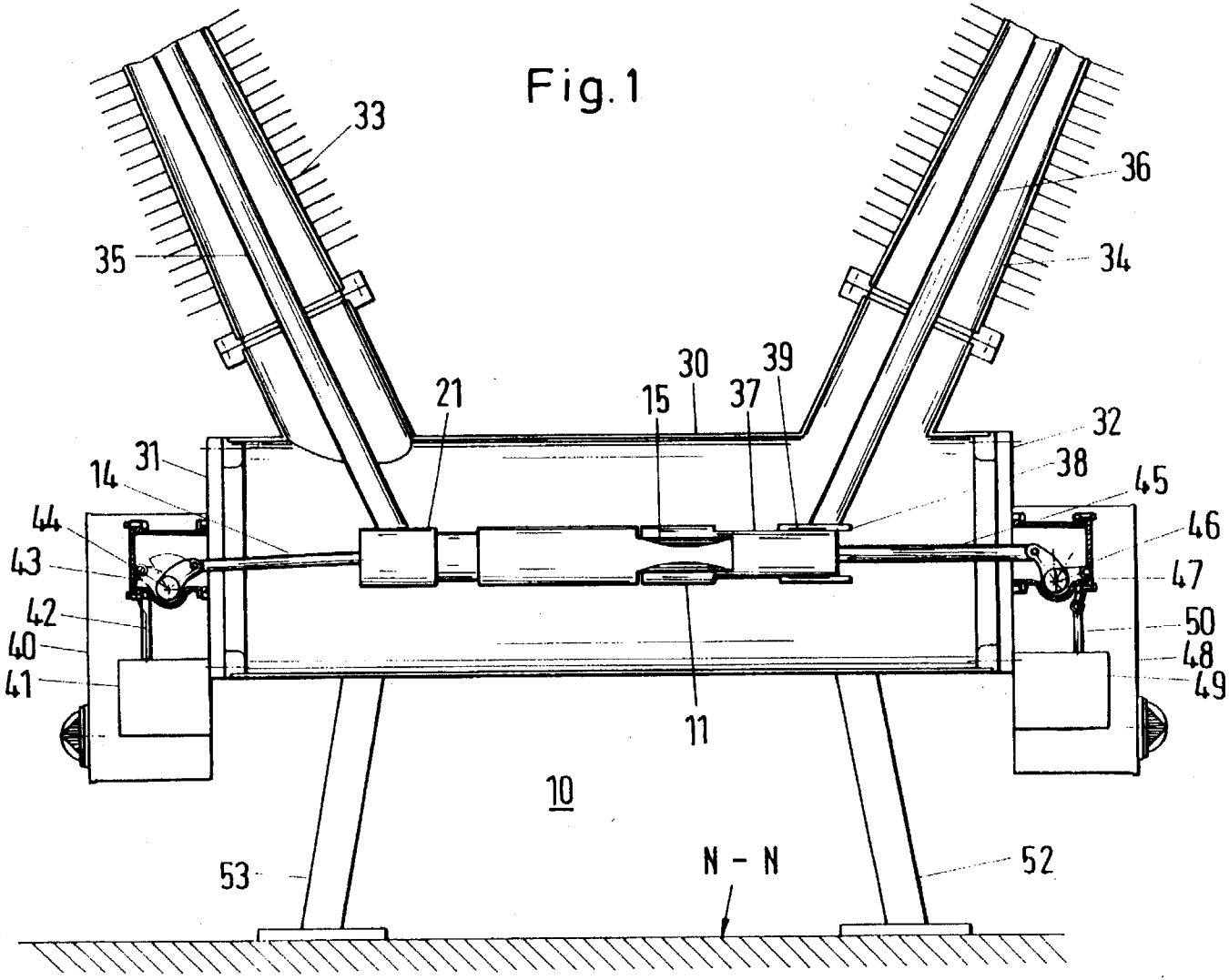
FIG. 1 is a fragmentary, diagrammatic, side-elevational view of a high-voltage switching device in a connected position, which is cut open to expose internal features.
Figure 2:
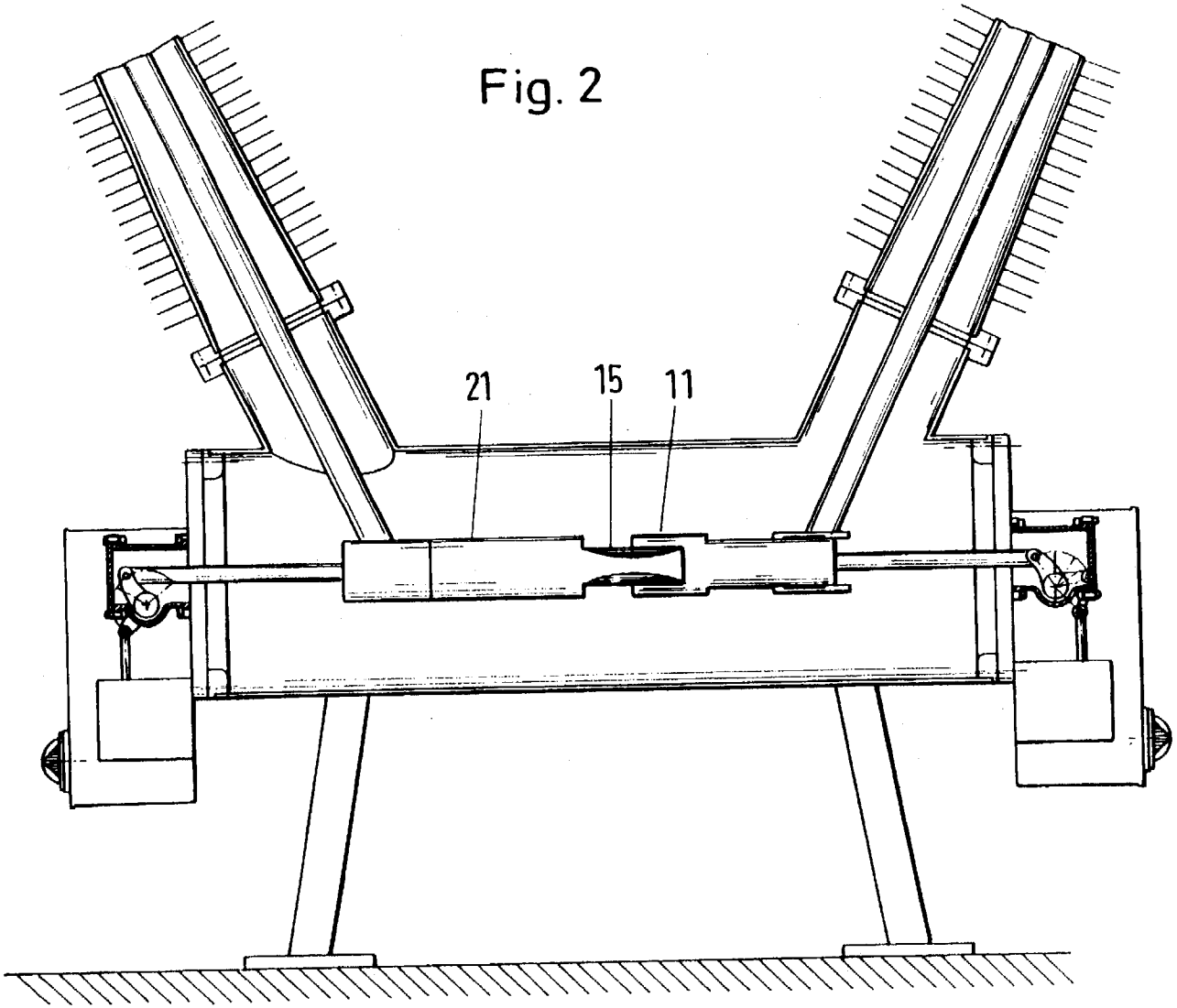
FIG. 2 is a view of the circuit-breaker according to FIG. 1, in a disconnection position.
Figure 3:
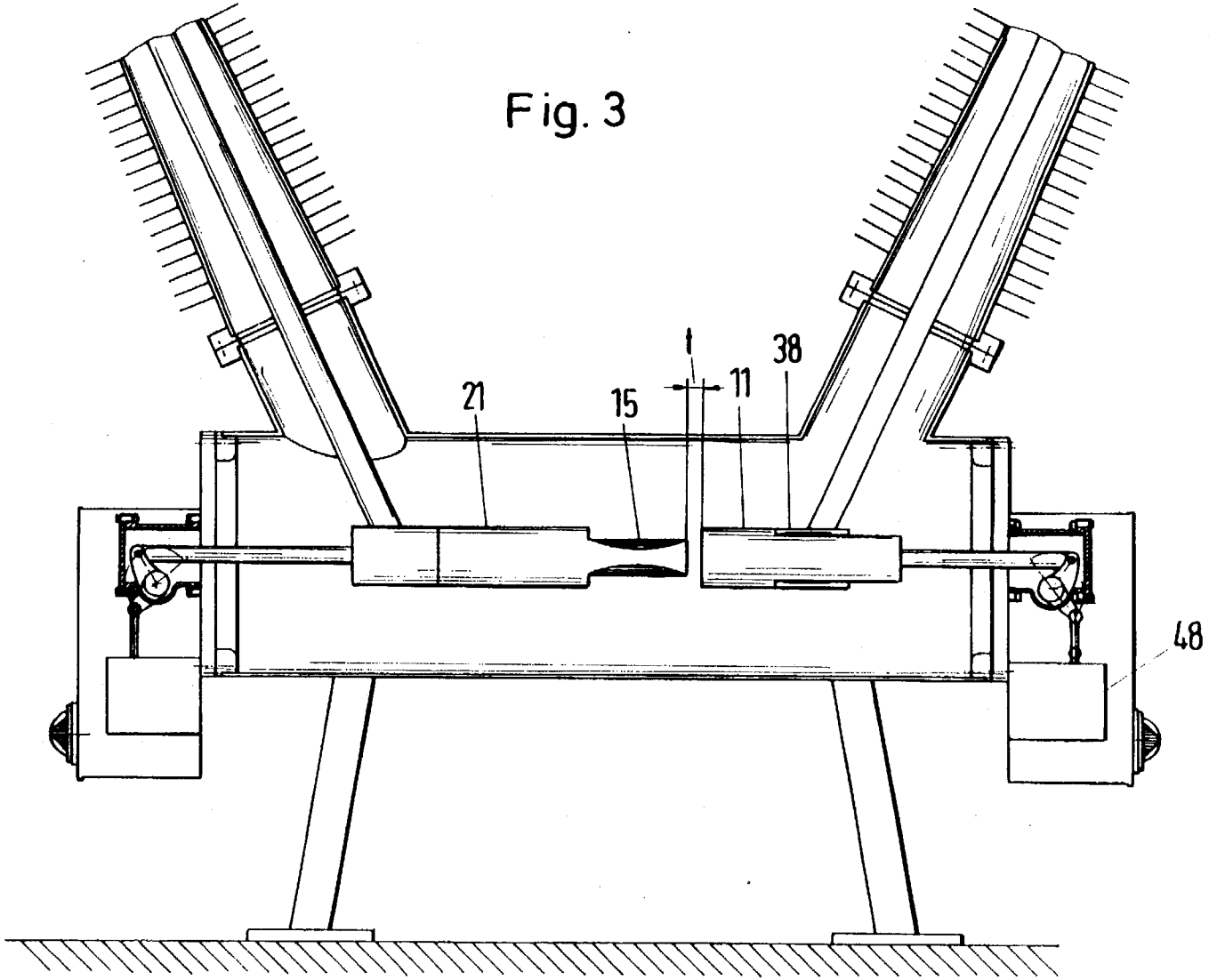
FIG. 3 is a view of the circuit-breaker according to FIGS. 1 and 2, in a disconnected position.

As can be seen from FIGS. 1 to 3, the switching device 10 according to FIG. 4 is accommodated in a metal encapsulation 30 which may be constructed in the form of a cylinder in the case of a single-pole configuration or may possibly be constructed to be oval in the case of a multipole configuration. The switching device 10 has ends which are connected through the use of covers 31 and 32, and outgoing lines 33 and 34 are provided in the region of the ends, forming a V-shape, transversely to the center axis of the metal encapsulation 30. The outgoing lines 33 and 34 are constructed as cable terminations through which current-carrying conductors 35 and 36 are passed. The conductor 35 is electrically conductively connected to the moving contact piece 13 within the contact housing 21. A projection 37 is disposed on the fixed contact housing 11 and passes through a guide or guide passage 38 with the interposition of so-called multi-laminate contacts 39. The guide 38 is electrically conductively connected to the conductor 36.

A drive 40 is connected to the drive rod 14, which is passed out of the contact housing 21. The drive 40 has a piston/cylinder configuration 41 having a piston rod 42 which is connected to the drive rod 14 through a direction-changing lever configuration 43 that is mounted in an axis of rotation 44. The projection 37, which is connected to the fixed contact housing 11, is connected through the use of a coupling rod 45 to a direction-changing lever configuration 46. The configuration 46 is mounted at a location 47 in such a way that it can rotate and it is connected to a drive 48. Similar to the drive 40, the drive 48 has a piston/cylinder configuration 49 with a piston rod 50 that is connected to the direction-changing lever configuration 46. The drive 48 can also be constructed with a motor-spindle configuration, because the movement by the drive 48 is relatively slow in comparison to the movement which the drive 40 carries out, since it is only necessary to carry out a disconnection movement.

The disconnecter switch movement can also be produced by a drive which is disposed on the same side as the drive 40, if the contact housing 21 is moved in order to achieve the disconnecter movement. In this case, the contact housing 21 must be guided displaceably through appropriate contact elements which correspond, for example, with the multi-laminated contacts 39, with respect to the conductor 35, and must be electrically conductively connected to the conductor 35. In this case, a two-position drive would have to be used as the drive 40, which initially carries out the power circuit-breaker movement, that is then followed by the disconnecter movement.

In the case of two separate drives, the drive 48 could also be disposed on the same side as the drive 40 and in this case, the drive 48 would move the contact housing 21.

The metal encapsulation 30 is mounted on legs 52, 53 on the ground N—N. The configuration according to FIG. 1 is in the connected position, while in contrast the disconnection position of the switching device 10 is illustrated in FIG. 2, and this disconnection position is illustrated in detail in FIG. 4. The dielectric nozzle 15 can be seen between the contact housing 21 of the moving contact piece and the fixed contact housing 11. The arc is blown and extinguished in the position shown in FIG. 2 and FIG. 4.

Once the extinguishing process has been completed, the contact housing 11 is displaced to the right in the guide 38 through the use of the drive 48, so that a distance t is formed between the free end of the nozzle 15 and the free end of the housing 11. This position according to FIG. 3 is the disconnected position.

If, in addition to the dielectric nozzle, the electrical switching device also has a dielectric cylinder between the contact housing 21 and the fixed contact housing 11, as is illustrated, for example, by the dashed line 51 in FIG. 4, then the dielectric cylinder 51 is moved together with the dielectric nozzle 15 in the disconnection direction and the fixed contact housing 11 is also isolated from the insulating cylinder during the disconnection movement. The isolating path t is necessary, as seen in FIG. 3.

The invention is illustrated with reference to a so-called dead tank circuit-breaker. The invention can, of course, likewise be used for any other gas-insulated circuit-breaker.

We claim:

1. A metal-encapsulated, gas-insulated high-voltage circuit-breaker, comprising:

a fixed contact housing;

a fixed contact configuration in said fixed contact housing;

an other contact housing;

a moving contact piece configuration in said other contact housing;

a drive for driving said moving contact piece configuration; and a device for producing a gas flow including a dielectric nozzle in which an arc burns and is blown, said dielectric nozzle being sealingly guided in said fixed contact housing throughout an entire switching operation;

said fixed contact housing with said fixed contact piece configuration and said other contact housing with said moving contact configuration being moved away from one another during or after completion of a disconnection operation, for releasing said dielectric nozzle from guidance and achieving an isolating path between said fixed contact housing and said other contact housing along with said dielectric nozzle to produce a disconnecter function; and another drive for driving said fixed contact housing counter to the disconnection direction of said moving contact piece configuration and for driving said other contact housing in the disconnection direction of said moving contact piece configuration.

2. The high-voltage circuit-breaker according to claim 1, wherein said other contact housing is connected to said moving contact piece configuration.

3. The high-voltage circuit-breaker according to claim 1, wherein said other contact housing can move with said moving contact piece configuration during a switching operation.

4. The high-voltage circuit-breaker according to claim 1, wherein said contact configuration has a contact piece for a rated current and for guiding and extinguishing the arc.

5. The high-voltage circuit-breaker according to claim 1, wherein said drive for said moving contact piece configuration also moves said other contact housing with said moving contact configuration and said dielectric nozzle into the disconnected position.

6. The high-voltage circuit-breaker according to claim 1, including an outgoing conductor, a guide passage being electrically conductively connected to said outgoing conductor, and a projection being integrally formed on at least one of said housings and accommodated in and electrically conductively and displaceably guided in said guide passage.

7. The high-voltage circuit-breaker according to claim 6, including multiple contact pieces achieving said electrically conductive connection between said guide passage and said projection.

8. The high-voltage circuit-breaker according to claim 1, wherein said drives are disposed on mutually opposite sides of said metal encapsulation.

9. The high-voltage circuit-breaker according to claim 1, wherein said drives are disposed at the same end of said metal encapsulation.

10. A metal-encapsulated, gas-insulated high-voltage circuit-breaker, comprising:

a fixed contact housing;

a fixed contact configuration in said fixed contact housing;

an other contact housing;

a moving contact piece configuration in said other contact housing;

a drive for driving said moving contact piece configuration;

a device for producing a gas flow including a dielectric nozzle in which an arc burns and is blown, said dielectric nozzle being sealingly guided in said fixed contact housing throughout an entire switching operation;

a dielectric cylinder between said other contact housing and said fixed contact housing;

said fixed contact housing with said fixed contact piece configuration and said other contact housing with said moving contact configuration being moved away from one another during or after completion of a disconnection operation, for releasing said dielectric nozzle from guidance, for releasing said dielectric cylinder from said fixed contact housing and for achieving an isolating path between said fixed contact housing and said other contact housing along with said dielectric nozzle and said dielectric cylinder to produce a disconnecter function; and another drive for driving said fixed contact housing counter to the disconnection direction of said moving contact piece configuration and for driving said other contact housing in the disconnection direction of said moving contact piece configuration.

11. The high-voltage circuit-breaker according to claim 10, wherein said other contact housing is connected to said moving contact piece configuration.

12. The high-voltage circuit-breaker according to claim 10, wherein said other contact housing can move with said moving contact piece configuration during a switching operation.

13. The high-voltage circuit-breaker according to claim 10, wherein said contact configuration has a contact piece for a rated current and for guiding and extinguishing the arc.

14. The high-voltage circuit-breaker according to claim 10, wherein said drive for said moving contact piece configuration also moves said other contact housing with said moving contact configuration, said dielectric nozzle and said dielectric cylinder into the disconnected position.

15. The high-voltage circuit-breaker according to claim 10, including an outgoing conductor, a guide passage being electrically conductively connected to said outgoing conductor, and a projection being integrally formed on at least one of said housings and accommodated in and electrically conductively and displaceably guided in said guide passage.

16. The high-voltage circuit-breaker according to claim 15, including multiple contact pieces achieving said electrically conductive connection between said guide passage and said projection.

17. The high-voltage circuit-breaker according to claim 10, wherein said drives are disposed on mutually opposite sides of said metal encapsulation.

18. The high-voltage circuit-breaker according to claim 10, wherein said drives are disposed at the same end of said metal encapsulation.

* * * * *